US008349134B2

(12) United States Patent
Esser et al.

(10) Patent No.: US 8,349,134 B2
(45) **Date of Patent: *Jan. 8, 2013**

(54) METHOD FOR PRODUCING HIGH DRY STRENGTH PAPER, PAPERBOARD OR CARDBOARD

(75) Inventors: Anton Esser, Mannheim (DE); Hans-Joachim Haehnle, Neustadt (DE); Martin Ruebenacker, Altrip (DE); Norbert Schall, Roemerberg (DE); Jacques Dupuis, Ketsch (DE); Josef Neutzner, Neustadt (DE); Manfred Niessner, Schifferstadt (DE); Berthold Sturm, Worms (DE)

(73) Assignee: BASF SE, Ludwigshafen (DE)

( * ) Notice: Subject to any disclaimer, the term of this patent is extended or adjusted under 35 U.S.C. 154(b) by 749 days.

This patent is subject to a terminal disclaimer.

(21) Appl. No.: 11/719,826

(22) PCT Filed: Nov. 21, 2005

(86) PCT No.: PCT/EP2005/012429

§ 371 (c)(1),
(2), (4) Date: May 21, 2007

(87) PCT Pub. No.: WO2006/056381

PCT Pub. Date: Jun. 1, 2006

(65) Prior Publication Data

US 2009/0145566 A1 Jun. 11, 2009

(30) Foreign Application Priority Data

Nov. 23, 2004 (DE) ..... 10 2004 056 551

(51) Int. Cl.
*D21H 21/18* (2006.01)
*D21H 17/33* (2006.01)
*D21H 17/56* (2006.01)

(52) U.S. Cl. ..... 162/168.2; 162/158; 162/164.1; 162/164.6; 162/168.1; 162/185

(58) Field of Classification Search ..... 162/158, 162/164.1, 164.6, 168.1, 168.2, 185
See application file for complete search history.

(56) References Cited

U.S. PATENT DOCUMENTS

| | | | | |
|---|---|---|---|---|
| 3,960,584 | A * | 6/1976 | Savage | 106/174.1 |
| 5,630,907 | A | 5/1997 | Nilz et al. | |
| 6,033,524 | A * | 3/2000 | Pruszynski et al. | 162/158 |
| 6,083,348 | A * | 7/2000 | Auhorn et al. | 162/183 |
| 6,132,558 | A * | 10/2000 | Dyllick-Brenzinger et al. | 162/164.6 |
| 6,824,650 | B2 * | 11/2004 | Lindsay et al. | 162/168.2 |
| 7,922,867 | B2 * | 4/2011 | Schall et al. | 162/158 |
| 2002/0053413 | A1 * | 5/2002 | Zhang et al. | 162/168.1 |
| 2003/0192664 | A1 * | 10/2003 | Kulick et al. | 162/164.1 |
| 2004/0118540 | A1 * | 6/2004 | Garnier et al. | 162/164.1 |
| 2004/0149411 | A1 | 8/2004 | Krueger et al. | |
| 2005/0061461 | A1 | 3/2005 | Linhart et al. | |
| 2006/0130991 | A1 * | 6/2006 | Solhage et al. | 162/158 |
| 2006/0142431 | A1 * | 6/2006 | Sutman et al. | 524/13 |
| 2006/0142432 | A1 * | 6/2006 | Harrington et al. | 524/13 |

FOREIGN PATENT DOCUMENTS

| | | | |
|---|---|---|---|
| AU | 6949591 | | 7/1991 |
| CA | 1110019 | | 10/1981 |
| CA | 2034655 | | 7/1991 |
| DE | 35 06 832 | A1 | 8/1986 |
| DE | 195 37 088 | A1 | 4/1997 |
| EP | 0 251 182 | A1 | 1/1988 |
| EP | 0 438 744 | A1 | 7/1991 |
| EP | 0 672 212 | B1 | 6/1996 |
| JP | 61-201097 | | 9/1986 |
| JP | 8-504239 | | 5/1996 |
| JP | 11-140787 | | 5/1999 |
| WO | WO 97/13033 | | 4/1997 |
| WO | WO 98/01623 | | 1/1998 |
| WO | WO 02/101144 | A1 | 12/2002 |
| WO | WO 03/052205 | A1 | 6/2003 |
| WO | WO 03/052206 | A1 | 6/2003 |
| WO | WO 2004/061235 | A1 | 7/2004 |

OTHER PUBLICATIONS

U.S. Appl. No. 06/826,318, filed Feb. 5, 1986.
U.S. Appl. No. 07/644,327, filed Jan. 22, 1991, Buechner, et al.

* cited by examiner

*Primary Examiner* — Matthew Daniels
*Assistant Examiner* — Dennis Cordray
(74) *Attorney, Agent, or Firm* — Oblon, Spivak, McClelland, Maier & Neustadt, L.L.P.

(57) ABSTRACT

The invention relates to a process for producing paper, board and cardboard of high dry strength by separately adding a polymer comprising vinylamine units and a polymeric anionic compound to a paper pulp, dewatering the pulp and drying the paper products, which comprises using as polymeric anionic compound at least one copolymer obtainable by copolymerizing (a) at least one N-vinylcarboxamide of the formula (I)

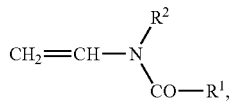

in which $R^1$ and $R^2$ are H or $C_1$- to $C_6$ alkyl, (b) at least one monoethylenically unsaturated monomer comprising acid groups, and/or the alkali metal, alkaline earth metal or ammonium salts thereof, and if appropriate (c) other monoethylenically unsaturated monomers, and if appropriate (d) compounds having at least two ethylenically unsaturated double bonds in their molecule.

17 Claims, No Drawings

METHOD FOR PRODUCING HIGH DRY STRENGTH PAPER, PAPERBOARD OR CARDBOARD

The invention relates to a process for producing paper, card and cardboard of high dry strength by separately adding a polymer comprising vinylamine units and a polymeric anionic compound to a paper pulp, dewatering the pulp, and drying the paper products.

In order to produce paper of high dry strength it is known to apply, to the surface of paper which has already been dried, dilute aqueous solutions of boiled starch or of synthetic polymers, each of which act as dry strength agents. The amounts of dry strength agent are generally 0.1 to 6% by weight, based on dry paper. Since the dry strength agents, including the starch, are applied in an aqueous dilute solution—in general the polymer concentration or starch concentration of the aqueous preparation solution is between 1% and 10% by weight, the subsequent drying operation involves evaporating a considerable amount of water. Consequently the drying step is very energy-intensive. The capacity of the customary drying installations on paper machines, however, is in many cases not sufficient to allow the machine to be run at the maximum possible production speed. Instead, the production speed of the paper machine has to be pegged back in order for the paper to dry adequately.

CA patent 1 110 019 discloses a process for producing paper of high dry strength by adding to the paper pulp first a water-soluble cationic polymer, polyethylenimine for example, and then a water-soluble anionic polymer, a hydrolyzed polyacrylamide for example, and dewatering the pulp on the paper machine, forming sheets. The anionic polymers comprise up to 30 mol % of acrylic acid in copolymerized form.

DE-A 35 06 832 discloses a process for producing paper of high dry strength by adding to the paper pulp first a water-soluble cationic polymer and then a water-soluble anionic polymer. Useful anionic polymers include, for example, homopolymers or copolymers of ethylenically unsaturated $C_3$-$C_5$ carboxylic acids. The copolymers comprise at least 35% by weight of an ethylenically unsaturated $C_3$-$C_5$ carboxylic acid (e.g. acrylic acid) in copolymerized form. Cationic polymers described in the examples include polyethylenimine, polyvinylamine, polydiallyldimethylammonium chloride, and epichlorhydrin-crosslinked condensation products of adipic acid and diethylenetriamine. Consideration was also given to using partially hydrolyzed homopolymers and copolymers of N-vinylformamide. The degree of hydrolysis of the N-vinylformamide polymers in that case is at least 30 mol % and is preferably 50 to 100 mol %.

JP-A 1999-140787 relates to a process for producing corrugated board where in order to improve the strength properties of a paper product 0.05% to 0.5% by weight, based on dry paper pulp, of a polyvinylamine is added to the paper pulp, said polyvinylamine being obtainable by hydrolyzing polyvinylformamide with a degree of hydrolysis of 25% to 100%, and being added in combination with an anionic polyacrylamide, and the paper pulp is then dewatered and dried.

WO 03/052206 discloses a paper product having improved strength properties that is obtainable by applying to the surface of a paper product a polyvinylamine and a polymeric anionic compound which is able to form a polyelectrolyte complex with polyvinylamine, or a polymeric compound having aldehyde functions, such as polysaccharides comprising aldehyde groups. Not only is an improvement obtained in the dry and wet strength of the paper but the treatment compositions are also observed to have a sizing effect.

WO 04/061235 discloses a process for producing paper, especially tissue, having particularly high wet and/or dry strengths, by adding to the paper pulp first a water-soluble cationic polymer that comprises at least 1.5 meq of primary amino functionalities per g of polymer and has a molecular weight of at least 10 000 daltons. Particular emphasis is given in that case to partially and fully hydrolyzed homopolymers of N-vinylformamide. Subsequently a water-soluble anionic polymer that comprises anionic and/or aldehydic groups is added. A particular advantage emphasized for this process is the variability of the two-component systems described in respect of various paper properties, including wet and dry strength.

EP-A 438 744 discloses the use of copolymers of, for example, N-vinylformamide and acrylic acid, methacrylic and/or maleic acid having a K value of 8 to 50 (determined by the method of H. Fikentscher in 1% strength aqueous solution at a pH of 7 and 25° C.), and of the polymers obtainable therefrom by partial or complete elimination of formyl groups from the copolymerized vinylformamide, to form vinylamine units as scale inhibitors in water-carrying systems such as boilers or pipes.

It is known, moreover, that copolymers obtainable by copolymerizing N-vinylcarboxamides, monoethylenically unsaturated carboxylic acids, and, if appropriate, other ethylenically unsaturated monomers, and subsequently hydrolyzing the vinylcarboxylic acid units comprised in the copolymers to give the corresponding amine or ammonium units, can be used in papermaking as an addition to the paper pulp for the purpose of increasing the dewatering rate, the retention, and the dry and wet strength of the paper; cf. EP-B 672 212.

It is an object of the present invention to provide a further process for producing paper of high dry strength and very low wet strength. In contradistinction to the existing processes, however, the increase in dry strength, particularly in packaging papers (e.g., testliner), is to be improved still further. Moreover, the wet strength, or the ratio of wet strength to dry strength, is to be further minimized.

This object is achieved in accordance with the invention with a process for producing producing paper, board and cardboard of high dry strength by separately adding a polymer comprising vinylamine units and a polymeric anionic compound to a paper pulp, dewatering the pulp and drying the paper products, which comprises using as polymeric anionic compound at least one copolymer obtainable by copolymerizing (a) at least one N-vinylcarboxamide of the formula

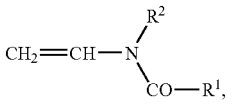

(I)

in which $R^1$ and $R^2$ are H or $C_1$- to $C_6$ alkyl, (b) at (east one monoethylenically unsaturated monomer comprising acid groups, and/or the alkali metal, alkaline earth metal or ammonium salts thereof, and if appropriate (c) other monoethylenically unsaturated monomers, and if appropriate (d) compounds having at least two ethylenically unsaturated double bonds in their molecule.

As said polymeric anionic compound it is preferred to use a copolymer obtainable by copolymerizing (a) N-vinylformamide,
(b) acrylic acid, methacrylic acid and/or the alkali metal or ammonium salts thereof, and if appropriate
(c) other monoethylenically unsaturated monomers.

The polymeric anionic compound comprises for example
(a) 10 to 95 mol % of units of the formula I
(b) 5 to 90 mol % of units of a monoethylenically unsaturated carboxylic acid having 3 to 8 carbon atoms in its molecule, and/or the alkali metal, alkaline earth metal or ammonium salts thereof, and
(c) 0 to 30 mol % of units of at least one other monoethylenically unsaturated monomer.

These compounds can be modified such that in addition they further comprise in copolymerized form at least one compound having at least two ethylenically unsaturated double bonds in its molecule. When the monomers (a) and (b) or (a), (b), and (c) are copolymerized in the presence of such a compound, branched copolymers are obtained. In this case the proportions and reaction conditions are to be chosen so that the resulting polymers are still soluble in water. In certain circumstances it may be necessary, for that purpose, to use polymerization regulators. Use may be made of any known regulators, such as thiols, secondary alcohols, sulfites, phosphites, hypophosphites, thio acids, and aldehydes, etc. (further details are found, for example, in EP-A 438 744, page 5, lines 7-12). The branched copolymers comprise in copolymerized form, for example,
(a) 10 to 95 mol % of units of the formula I
(b) 5 to 90 mol % of units of a monoethylenically unsaturated monomer comprising acid groups, and/or the alkali metal, alkaline earth metal or ammonium salts thereof,
(c) 0 to 30 mol % of units of at least one other monoethylenically unsaturated monomer, and
(d) 0 to 2 mol %, preferably 0.001 to 1 mol %, of at least one compound having at least two ethylenically unsaturated double bonds.

Examples of monomers of group (a) are N-vinylformamide, N-vinyl-N-methylformamide, N-vinylacetamide. N-vinyl-N-methylacetamide, N-vinyl-N-ethylacetamide, N-vinyl-N-methylpropionamide, and N-vinylpropionamide. The monomers of group (a) may be used alone or in a mixture for copolymerization with the monomers of the other groups.

Particularly useful monomers of group (b) are monoethylenically unsaturated carboxylic acids having 3 to 8 carbon atoms, and the water-soluble salts of these carboxylic acids. This group of monomers includes, for example, acrylic acid, methacrylic acid, dimethacrylic acid, ethacrylic acid, maleic acid, fumaric acid, itaconic acid, mesaconic acid, citraconic acid, methylenemalonic acid, allylacetic acid, vinylacetic acid, and crotonic acid. Further suitable group (b) monomers include monomers comprising sulfo groups, such as vinylsulfonic acid, acrylamido-2-methyl-propanesulfonic acid, and styrenesulfonic acid, and vinylphosphonic acid. The monomers of this group can be used alone or in a mixture with one another, in partially or fully neutralized form, in the copolymerization. Neutralization is performed using, for example, alkali metal bases or alkaline earth metal bases, ammonia, amines and/or alkanolamines. Examples thereof include sodium hydroxide, potassium hydroxide, sodium carbonate, potassium carbonate, sodium hydrogen carbonate, magnesium oxide, calcium hydroxide, calcium oxide, triethanolamine, ethanolamine, morpholine, diethylenetriamine or tetraethylenepentamine. The group (b) monomers are used preferably in partially neutralized form for the copolymerization.

For the purpose of modification the copolymers may if appropriate comprise monomers of group (c) in copolymerized form, examples being esters of ethylenically unsaturated $C_3$- to $C_5$ carboxylic acids, such as methyl acrylate, ethyl acrylate, n-butyl acrylate, isobutyl acrylate, isobutyl methacrylate, methyl methacrylate, and ethyl methacrylate, and vinyl esters, examples being vinyl acetate or vinyl propionate, or other monomers, such as N-vinylpyrrolidone, N-vinylimidazole, acrylamide and/or methacrylamide.

Further modification to the copolymers is possible by using, during the copolymerization, monomers (d) which comprise at least two double bonds in their molecule, examples being methylenebisacrylamide, glycol diacrylate, glycol dimethacrylate, glyceryl triacrylate, triallylamine, pentaerythritol triallyl ether, polyalkylene glycols at least doubly esterified with acrylic acid and/or methacrylic acid, or polyols such as pentaerythritol, sorbitol or glucose. If at least one group (d) monomer is used in the copolymerization, the amounts employed are up to 2 mol %, e.g. 0.001 to 1 mol %.

The monomers are copolymerized in a known way in the presence of free-radical polymerization initiators and, if appropriate, in the presence of polymerization regulators; cf. EP-B 672 212, page 4, lines 13-37, or EP-A 438 744, page 2, line 26 to page 8, line 18.

Also useful as said polymeric anionic compound are amphoteric copolymers obtainable by copolymerizing
(a) at least one N-vinylcarboxamide of the formula

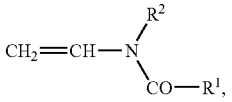

(I)

in which $R^1$ and $R^2$ are H or $C_1$- to $C_6$ alkyl,
(b) at least one monoethylenically unsaturated carboxylic acid having 3 to 8 carbon atoms in its molecule, and/or the alkali metal, alkaline earth metal or ammonium salts thereof, and if appropriate
(c) other monoethylenically unsaturated monomers, and if appropriate
(d) compounds having at least two ethylenically unsaturated double bonds in their molecule, and then partly eliminating groups —CO—R' from the monomers of the formula I copolymerized in the copolymer, to form amino groups, the amount of amino groups in the copolymer being at least 5 mol % below the amount of copolymerized monomers (b) comprising acid groups. The hydrolysis of N-vinylcarboxamide polymers produces, in a secondary reaction, amidine units, through reaction of vinylamine units with an adjacent vinylformamide unit. References below to vinylamine units in the amphoteric copolymers always cover the total of vinylamine units and amidine units.

The amphoteric compounds thus obtainable comprise in copolymerized form for example
(a) 10 to 95 mol % of units of the formula I
(b) 5 to 90 mol % of units of a monoethylenically unsaturated monomer comprising acid groups, and/or the alkali metal, alkaline earth metal or ammonium salts thereof,
(c) 0 to 30 mol % of units of at least one other monoethylenically unsaturated monomer,
(d) 0 to 2 mol % of units of at least one compound having at least two ethylenically unsaturated double bonds in its molecule, and
(e) 0 to 42 mol % of vinylamine units, the amount of amino groups in the copolymer being at least 5 mol % below the amount of copolymerized monomers (b) comprising acid groups.

The hydrolysis of the anionic copolymers can be carried out in the presence of acids or bases or else enzymatically. In the case of hydrolysis with acids the vinylamine groups formed from the vinylcarboxamide units are in salt form. The hydrolysis of vinylcarboxamide copolymers is described at length in EP-A 438 744, page 8, line 20 to page 10, line 3. The remarks made therein apply correspondingly to the preparation of the amphoteric polymers for use in accordance with the invention.

As said polymeric anionic compound it is preferred to use a copolymer comprising in copolymerized form (a) 50 to 90 mol % of N-vinylformamide, (b) 10 to 50 mol % of acrylic acid, methacrylic acid and/or the alkali metal or ammonium salts thereof, and if appropriate (c) 0 to 30 mol % of at least one other monoethylenically unsaturated monomer.

The average molar masses $M_w$ of the anionic or amphoteric polymers are for example 30 000 D to 10 million D, preferably 100 000 D to 1 million D. These polymers have, for example. K values (determined by the method of H. Fikentscher in 5% strength aqueous sodium chloride solution at a pH of 7, a polymer concentration of 0.5% by weight, and a temperature of 25° C.) in the range from 20 to 250, preferably 50 to 150.

In the process of the invention first of all a polymeric cationic component is added to the paper pulp, said component exclusively comprising polymers comprising vinylamine units. Suitability for this purpose is possessed by all polymers which are specified, for example, in the cited prior art document WO 04/061235, page 12, line 28 to page 13, line 21, and in FIG. 1. The molar mass $M_w$ of the polymers comprising vinylamine units is for example 1000 to 5 million and is mostly in the range from 5000 to 500 000, preferably 40 000 D to 400 000 D.

The other group of polymers, i.e., polymers comprising vinylamine units, are obtainable for example by polymerizing at least one monomer of the formula

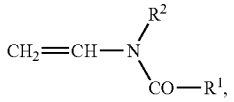

(I)

in which $R^1$ and $R^2$ are H or $C_1$- to $C_6$ alkyl, and then partly or completely eliminating the groups —CO—$R^1$ from the monomer I units copolymerized in the polymer, to form amino groups. As already set out above, it is possible in a secondary reaction for amidine units to be formed, from vinylamine units and adjacent vinylformamide units. For the cationic polymers described here, as well, the reference to vinylamine units comprises the sum of vinylamine units and amidine units in the polymer. As said polymer comprising vinylamine units use is made, for example, of an at least 10 mol % hydrolyzed homopolymer of N-vinylformamide. Polyvinylamine and/or at least 50 mol % hydrolyzed homopolymers of N-vinylformamide are used preferably as a cationic component in the process of the invention.

In the process of the invention it is also possible as a cationic component to use amphoteric copolymers, provided they have at least 10 mol % more cationic than anionic groups. Amphoteric polymers of this kind are obtainable for example by copolymerizing (a) at least one N-vinylcarboxamide of the formula

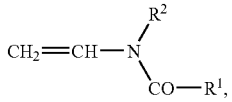

(I)

in which $R^1$ and $R^2$ are H or $C_1$- to $C_6$ alkyl, (b) at least one monoethylenically unsaturated monomer comprising acid groups, and/or the alkali metal, alkaline earth metal or ammonium salts thereof, and if appropriate (c) other monoethylenically unsaturated monomers, and if appropriate (d) compounds having at least two ethylenically unsaturated double bonds in their molecule and then partly or completely eliminating the groups —CO—$R^1$ from the monomer I units copolymerized in the polymer, to form amino groups, the fraction of amino groups in the copolymer being greater by at least 10 mol % than the fraction of units of monoethylenically unsaturated monomers comprising acid groups.

These polymers are obtainable by the same process as the amphoteric polymers described above, which are used inventively as an anionic component, with the sole exception that in this case the ratio of cationic to anionic groups is different, so that cationic polymers are now obtained. This group of polymers comprises, for example, up to a maximum of 35 mol %, preferably up to a maximum of 10 mol %, of at least one group (b) monomer comprising acid groups.

Fibers suitable for preparing the pulps include all qualities customary for that purpose, examples being mechanical pulp, bleached and unbleached chemical pulp, and paper stocks from all annual plants. Mechanical pulp includes, for example, groundwood, thermomechanical pulp (TMP), chemothermomechanical pulp (CTMP), pressure groundwood, semi-chemical pulp, high-yield pulp, and refiner mechanical pulp (RMP). Suitable chemical pulps include, for example, sulfate, sulfite, and soda pulps. Preference is given to using unbleached chemical pulp, also referred to as unbleached kraft pulp. Suitable annual plants for producing paper pulps are, for example, rice, wheat, sugar cane, and kenaf. The pulps are mostly produced using waste paper, which is used either alone or in a mixture with other fibers, or else the starting materials are fiber mixtures comprising a primary stock and recycled coated broke: for example, bleached pine sulfate mixed with recycled coated broke. The process of the invention has importance in particular for the production of paper and board from waste paper, since it significantly enhances the strength properties of the recycled fibers.

The pH of the pulp suspension is situated for example in the range from 4.5 to 8, mostly 6 to 7.5. The pH can be adjusted using, for example, an acid such as sulfuric acid or aluminum sulfate.

The polymer comprising vinylamine units, i.e., the cationic component of the polymers to be added to the paper pulp, is added, in the process of the invention, to the high-consistency stock or, preferably, to a low-consistency stock. The point of addition is preferably situated before the wires, but may also be situated between a shearing stage and a screen, or thereafter. The anionic component is mostly not added until after the cationic component has been added to the paper pulp, but may also be added to the paper pulp at the same time, though separately from the cationic component. It is also possible, moreover, to add first the anionic component and subsequently the cationic component. The polymer comprising vinylamine units and the polymeric anionic compound are each used, for example, in an amount of 0.1% to 2.0% by weight, preferably 0.3% to 1% by weight, based on dry paper pulp. The ratio of polymer comprising vinylamine units to polymeric anionic compound is for example 5:1 to 1:5 and is preferably in the range from 2:1 to 1:2.

According to the process of the invention, paper products are obtained which in relation to the prior art processes combine a higher dry strength level with a low wet strength.

The parts specified in the examples below are by weight, and the percentages relate to the weight of the substances. The K value of the polymers was determined by the method of Fikentscher, Cellulose-Chemie, volume 13, 58-64 and 71-74 (1932), at a temperature of 20° C. in 5% strength by weight aqueous sodium chloride solutions, at a pH of 7 and a polymer concentration of 0.5%. K=k*1000.

For the individual tests, sheets were produced in laboratory tests in a Rapid-Curtain laboratory sheet former. The dry breaking length was determined in accordance with DIN 53 112, Sheet 1, and the wet breaking length in accordance with DIN 53 112, Sheet 2. The GMT value was determined in accordance with DIN 53 143, and the dry bursting pressure in accordance with DIN 53 141.

EXAMPLES

From 100% mixed waste paper a 0.5% aqueous pulp suspension was prepared. The pH of the suspension was 7.1 and the fineness of the pulp was 50° Schopper-Riegler (°SR). The pulp suspension was then divided into 36 equal parts and was processed, in Comparative Examples 1 to 26 and Inventive Examples 27 to 36, under the following conditions, to give sheets with a basis weight of 120 g/m$^2$.

Comparative Example 1

A sheet was formed from the above-described pulp suspension with no further additions.

Comparative Examples 2-6 in Accordance with DE-A 35 06 832

Further samples of the above-described pulp suspension were admixed, based on dry fiber, first with the amounts specified in Table 1 of a polyvinylamine (PVAm 1) having a K value of 110 (prepared by hydrolyzing polyvinylformamide, degree of hydrolysis 95%) and, after a residence time of 5 minutes, with the amounts, likewise indicated in Table 1, of a copolymer of 60% acrylic acid and 40% acrylonitrile (copolymer 1). The copolymer was in the form of the sodium salt and had a K value of 130. After an exposure time of 1 minute, each of the paper pulps thus treated was deviate red and formed to sheets.

TABLE 1

| Comparative Example | PVAm 1 [%] | Copolymer 1 [%] |
|---|---|---|
| 1 | 0 | 0 |
| 2 | 0.25 | 0.25 |
| 3 | 0.5 | 0.5 |
| 4 | 0.5 | 1 |
| 5 | 1 | 0.5 |
| 6 | 1 | 1 |

Comparative Examples 7-11 in Accordance with DA-A 35 06 832

Further samples of the above-described pulp suspension were admixed, based on dry fiber, with the amounts, specified in Table 2, of a polyethylenimine having a viscosity in 10% strength aqueous solution of 30 m·Pas. After an exposure time of 5 minutes the amounts likewise indicated in Table 2, based on dry fiber, of a copolymer of 50% acrylic acid and 50% acrylonitrile (copolymer 2) were added. The copolymer was in the form of the sodium salt and had a K value of 120. After an exposure time of 1 minute the paper pulp thus treated was also dewatered and formed to sheets.

TABLE 2

| No. | Polyethylenimine [%] | Copolymer 2 [%] |
|---|---|---|
| 7 | 0.25 | 0.25 |
| 8 | 0.5 | 0.5 |
| 9 | 0.5 | 1 |
| 10 | 1 | 0.5 |
| 11 | 1 | 1 |

Comparative Examples 12-16 in Accordance with WO 04/061235

Further samples of the above-described pulp suspension were admixed, based on dry fiber, with the amounts indicated in Table 3 of a polyvinylamine (PVAm 2) having a K value of 90 (Catiofast® PR 8106 from BASF, prepared by hydrolyzing polyvinylformamide, degree of hydrolysis 90%). After a residence time of 5 minutes the amounts likewise indicated in Table 3 of a glyoxylated cationic polyacrylamide (cationic copolymer 1, sold by Bayer AG under the name Parez® 631NC) were added to the paper pulp suspension. After an exposure time of 1 minute each of the paper pulps thus treated was dewatered and formed to sheets.

TABLE 3

| No. | PVAm 2 [%] | Cationic copolymer 1 [%] |
|---|---|---|
| 12 | 0.25 | 0.25 |
| 13 | 0.5 | 0.5 |
| 14 | 0.5 | 1 |
| 15 | 1 | 0.5 |
| 16 | 1 | 1 |

Comparative Examples 17-21 in Accordance with WO 04/061235

Further samples of the above-described pulp suspension were admixed, based on dry fiber, with the amounts indicated in Table 4 of a polyvinylamine (PVAm 2) having a K value of 90 (prepared by hydrolyzing polyvinylformamide, degree of hydrolysis 90%). After a residence time of 5 minutes the amounts indicated in each case in Table 4 of a copolymer of 80% acrylic acid and 20% acrylamide (copolymer 4) were added. The copolymer was in the form of the sodium salt and had a K value of 120. After an exposure time of 1 minute each of the paper pulps thus treated was dewatered and formed to sheets.

TABLE 4

| No. | PVAm [%] | Copolymer 4 [%] |
|---|---|---|
| 17 | 0.25 | 0.25 |
| 18 | 0.5 | 0.5 |
| 19 | 0.5 | 1 |
| 20 | 1 | 0.5 |
| 21 | 1 | 1 |

Comparative Examples 22-26 in Accordance with WO 04/061235

Further samples of the above-described pulp suspension were admixed, based on dry fiber, with the amounts indicated in each case in Table 5 of a polyvinylamine (PVAm 2) having a K value of 90 (Catiofast® PR 8106, prepared by hydrolyzing polyvinylformamide, degree of hydrolysis 90%). After a residence time of 5 minutes the amounts indicated in each case in Table 5 of an anionic glyoxylated copolymer of acrylic acid and acrylamide (copolymer 3, available under the name Parez® from Bayer AG) were added. After an exposure time of 1 minute each of the paper pulps thus treated was dewatered and formed to sheets.

TABLE 5

| No. | PVAm 2 [%] | Copolymer 3 [%] |
|---|---|---|
| 22 | 0.25 | 0.25 |
| 23 | 0.5 | 0.5 |
| 24 | 0.5 | 1 |
| 25 | 1 | 0.5 |
| 26 | 1 | 1 |

Inventive Examples 1-5

Further samples of the above-described pulp suspension were admixed, based on dry fiber, with the amounts indicated in each case in Table 6 of a polyvinylamine (PVAm 3) having a K value of 90 (prepared by hydrolyzing polyvinylformamide, degree of hydrolysis 50%). After a residence time of 5 minutes the amounts likewise Indicated in each case in Table 6 of a copolymer of 30% acrylic acid and 70% vinylformamide (copolymer 4) were then added. The copolymer was in the form of the sodium salt and had a K value of 90. After an exposure time of 1 minute each of the paper pulps thus treated was then dewatered, and formed to sheets. The test results are compiled in Table 8.

TABLE 6

| Example No. | Test No. | PVAm 3 [%] | Copolymer 4 [%] |
|---|---|---|---|
| 1 | 27 | 0.25 | 0.25 |
| 2 | 28 | 0.5 | 0.5 |
| 3 | 29 | 0.5 | 1 |
| 4 | 30 | 1 | 0.5 |
| 5 | 31 | 1 | 1 |

Inventive Examples 6-10

Further samples of the above-described pulp suspension were admixed, based on dry fiber, with the amounts indicated in each case in Table 7 of a polyvinylamine (PVAm 4) having a K value of 90 (30% hydrolyzed polyvinylformamide). After a residence time of 5 minutes the amounts indicated in each case in Table 7 of a copolymer of 30% acrylic acid and 70% vinylformamide (copolymer 4) were then added. The copolymer was in the form of the sodium salt and had a K value of 90. After an exposure time of 1 minute each of the paper pulps thus treated was then dewatered, and formed to sheets. The test results are compiled in Table 8.

TABLE 7

| Example No. | Test No. | PVAm 4[%] | Copolymer 4 [%] |
|---|---|---|---|
| 6 | 32 | 0.25 | 0.25 |
| 7 | 33 | 0.5 | 0.5 |
| 8 | 34 | 0.5 | 1 |
| 9 | 35 | 1 | 0.5 |
| 10 | 36 | 1 | 1 |

The paper sheets each, produced in Comparative Examples 1-26 and Examples 1-10 were tested for dry and wet breaking length, GMT value and dry bursting pressure by the methods indicated above. The results of the tests, performed on the sheets formed in each case, are given in Table 8 under test Nos. 1 to 36. The test numbers 27-36 are inventive examples.

TABLE 8

| Test No. | X [%] | Y [%] | Bursting pressure [kPa] | DBL [m] | WBL [m] | $CMT_{30}$ [N] | Rel. WBL [%] |
|---|---|---|---|---|---|---|---|
| 1 | 0 | 0 | 339 | 3971 | 156 | 152 | 3.93 |
| 2 | 0.25 | 0.25 | 394 | 4587 | 617 | 184 | 13.45 |
| 3 | 0.5 | 0.5 | 423 | 4712 | 656 | 194 | 13.92 |
| 4 | 0.5 | 1 | 409 | 4918 | 678 | 204 | 13.76 |
| 5 | 1 | 0.5 | 431 | 5134 | 729 | 189 | 14.20 |
| 6 | 1 | 1 | 451 | 5094 | 712 | 208 | 13.97 |
| 7 | 0.25 | 0.25 | 379 | 4601 | 691 | 181 | 15.02 |
| 8 | 0.5 | 0.5 | 412 | 4799 | 734 | 201 | 15.29 |
| 9 | 0.5 | 1 | 429 | 4894 | 746 | 187 | 15.24 |
| 10 | 1 | 0.5 | 434 | 4765 | 775 | 209 | 16.26 |
| 11 | 1 | 1 | 445 | 4943 | 821 | 202 | 16.61 |
| 12 | 0.25 | 0.25 | 365 | 4425 | 728 | 147 | 16.45 |
| 13 | 0.5 | 0.5 | 403 | 4877 | 838 | 171 | 17.18 |
| 14 | 0.5 | 1 | 414 | 4933 | 856 | 186 | 17.35 |
| 15 | 1 | 0.5 | 407 | 4861 | 876 | 181 | 18.02 |
| 16 | 1 | 1 | 421 | 4929 | 899 | 189 | 18.24 |
| 17 | 0.25 | 0.25 | 387 | 4416 | 692 | 161 | 15.67 |
| 18 | 0.5 | 0.5 | 411 | 4779 | 789 | 187 | 16.51 |
| 19 | 0.5 | 1 | 405 | 4634 | 767 | 179 | 16.55 |
| 20 | 1 | 0.5 | 413 | 4729 | 802 | 183 | 16.96 |
| 21 | 1 | 1 | 402 | 4743 | 812 | 192 | 17.12 |
| 22 | 0.25 | 0.25 | 371 | 4367 | 699 | 151 | 16.01 |
| 23 | 0.5 | 0.5 | 405 | 4823 | 782 | 168 | 16.23 |
| 24 | 0.5 | 1 | 416 | 4934 | 828 | 173 | 16.78 |
| 25 | 1 | 0.5 | 407 | 4912 | 803 | 176 | 16.34 |
| 26 | 1 | 1 | 422 | 5013 | 845 | 183 | 16.85 |
| 27 | 0.25 | 0.25 | 406 | 4626 | 547 | 172 | 11.83 |
| 28 | 0.5 | 0.5 | 488 | 5443 | 625 | 229 | 11.48 |
| 29 | 0.5 | 1 | 474 | 5278 | 600 | 226 | 11.36 |
| 30 | 1 | 0.5 | 471 | 5223 | 624 | 216 | 11.96 |
| 31 | 1 | 1 | 496 | 5511 | 638 | 232 | 11.57 |
| 32 | 0.25 | 0.25 | 399 | 4589 | 435 | 179 | 9.49 |
| 33 | 0.5 | 0.5 | 444 | 5321 | 515 | 224 | 9.68 |
| 34 | 0.5 | 1 | 459 | 5181 | 484 | 222 | 9.34 |
| 35 | 1 | 0.5 | 467 | 5229 | 525 | 217 | 10.04 |
| 36 | 1 | 1 | 483 | 5412 | 531 | 233 | 9.82 |

The key to the abbreviations used in Table 8 is as follows:
X: amount of cationic component used
Y: amount of anionic component used
DBL: dry breaking length
WBL: wet breaking length
Rel. WBL: relative wet breaking length As can be seen from Table 8, the highest dry strength level in conjunction with lowest wet strength is achieved with the inventive combination of test Nos. 27-36 in contrast to the comparative examples of test numbers 1 to 26. Also deserving of emphasis is the significantly lower level of wet strengthening when a polyvinylamine having a relatively low degree of hydrolysis is used as cationic component (cf. Examples 6 to 10).

The invention claimed is:

1. A process for producing paper, board and cardboard of high dry strength by separately adding a polymer comprising vinylamine units and a polymeric anionic compound to a paper pulp, dewatering the pulp and drying the paper products, wherein said polymeric anionic compound consists of the following monomers which are copolymerized:

(a) at least one N-vinylcarboxamide of the formula

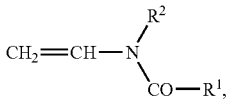

(I)

in which $R^1$ and $R^2$ are H or $C_1$ to $C_6$ alkyl, (b) at least one acidic monoethylenically unsaturated monomer and/or the alkali metal, alkaline earth metal or ammonium salts thereof, and, optionally, (c) at least one other monoethylenically unsaturated monomer selected from the group consisting of methyl acrylate, ethyl acrylate, methyl methacrylate, ethyl methacrylate, vinyl ester, N-vinylpyrrolidone, N-vinylimidazole, acrylamide and methacrylamide.

2. The process according to claim 1, wherein said polymeric anionic compound consists of the following monomers which are copolymerized:

(a) N-vinylformamide, (b) acrylic acid, methacrylic acid, and/or the alkali metal or ammonium salts thereof, and, optionally, (c) at least one other monoethylenically unsaturated monomer selected from the group consisting of methyl acrylate, ethyl acrylate, methyl methacrylate, ethyl methacrylate, vinyl ester, N-vinylpyrrolidone, N-vinylimidazole, acrylamide and methacrylamide.

3. The process according to claim 1, wherein said polymeric anionic compound consists of the following monomers which are copolymerized:

(a) 10 to 95 mol % of units of the formula I, (b) 5 to 90 mol % of units of a monoethylenically unsaturated carboxylic acid having 3 to 8 carbon atoms in its molecule, and/or the alkali metal, alkaline earth metal or ammonium salts thereof, and (c) 0 to 30 mol % of units of at least one other monoethylenically unsaturated monomer selected from the group consisting of methyl acrylate, ethyl acrylate, methyl methacrylate, ethyl methacrylate, vinyl ester, N-vinylpyrrolidone, N-vinylimidazole, acrylamide and methacrylamide.

4. The process according to claim 1, wherein said polymeric anionic compound consists of the following monomers which are copolymerized:

(a) 10 to 95 mol % of units of the formula I, (b) 5 to 90 mol % of units of an acidic monoethylenically unsaturated monomer, and/or the alkali metal, alkaline earth metal or ammonium salts thereof, and (c) 0 to 30 mol % of units of at least one other monoethylenically unsaturated monomer selected from the group consisting of methyl acrylate, ethyl acrylate, methyl methacrylate, ethyl methacrylate, vinyl ester, N-vinylpyrrolidone, N-vinylimidazole, acrylamide and methacrylamide.

5. A process for producing paper, board and cardboard of high dry strength by separately adding a polymer comprising vinylamine units and a polymeric anionic compound to a paper pulp, dewatering the pulp and drying the paper products, wherein said polymeric anionic compound consists of the following monomers which are copolymerized:

(a) at least one N-vinylcarboxamide of the formula

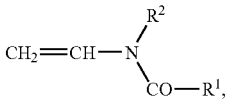

(I)

in which $R^1$ and $R^2$ are H or $C_1$ to $C_6$ alkyl, (b) at least one monoethylenically unsaturated carboxylic acid having 3 to 8 carbon atoms in its molecule, and/or the alkali metal, alkaline earth metal or ammonium salts thereof, optionally, (c) at least one other monoethylenically unsaturated monomer selected from the group consisting of methyl acrylate, ethyl acrylate, methyl methacrylate, ethyl methacrylate, vinyl ester, N-vinylpyrrolidone, N-vinylimidazole, acrylamide and methacrylamide, and (d) a monomer containing vinylamine units, wherein the vinylamine units (e) are obtained by partly eliminating groups —CO—$R^1$ from the monomers of the formula I copolymerized in the copolymer to form amino groups, wherein the amount of amino groups in the copolymer is at least 5 mol % below the amount of copolymerized acidic monomers (b).

6. The process according to claim 5, wherein said polymeric anionic compound consists of the following monomers which are copolymerized:

(a) 10 to 95 mol % of units of the formula I, (b) 5 to 90 mol % of units of an acidic monoethylenically unsaturated monomer, and/or the alkali metal, alkaline earth metal or ammonium salts thereof, (c) 0 to 30 mol % of units of at least one other monoethylenically unsaturated monomer selected from the group consisting of methyl acrylate, ethyl acrylate, methyl methacrylate, ethyl methacrylate, vinyl ester, N-vinylpyrrolidone, N-vinylimidazole, acrylamide and methacrylamide, (d) 0 to 42 mol % of vinylamine units, wherein the amount of amino groups in the copolymer is at least 5 mol % below the amount of copolymerized acidic monomers (b).

7. The process according to claim 1, wherein said polymeric anionic compound consists of the following monomers which are copolymerized:

(a) 50 to 90 mol % of N-vinylformamide, (b) 10 to 50 mol % of acrylic acid, methacrylic acid and/or the alkali metal or ammonium salts thereof, and, optionally, (c) 0 to 30 mol % of at least one other monoethylenically unsaturated monomer selected from the group consisting of methyl acrylate, ethyl acrylate, methyl methacrylate, ethyl methacrylate, vinyl ester, N-vinylpyrrolidone, N-vinylimidazole, acrylamide and methacrylamide.

8. The process according to claim 1, wherein said polymer comprising vinylamine units comprises at least one compound which is obtained by polymerizing at least one monomer of the formula I

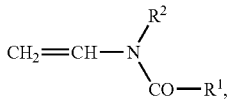

(I)

in which $R^1$ and $R^2$ are H or $C_1$ to $C_6$ alkyl, and then partly or completely eliminating the groups —CO—$R^1$ from the monomer I units copolymerized in the polymer to form amino groups.

9. The process according to claim 1, wherein said polymer comprising vinylamine units comprises at least 10 mol % hydrolyzed homopolymer of N-vinylformamide.

10. The process according to claim 1, wherein said polymer comprising vinylamine units comprises a copolymer which is obtained by copolymerizing a) at least one N-vinylcarboxamide of the formula

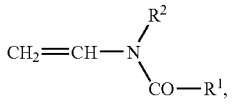

(I)

in which $R^1$ and $R^2$ are H or $C_1$ to $C_6$ alkyl, b) at least one acidic monoethylenically unsaturated monomer, and/or the alkali metal, alkaline earth metal or ammonium salts thereof, and, optionally, c) at least one other monoethylenically unsaturated monomer selected from the group consisting of methyl acrylate, ethyl acrylate, methyl methacrylate, ethyl methacrylate, vinyl ester, N-vinylpyrrolidone, N-vinylimidazole, acrylamide and methacrylamide, and, optionally, d) at least one compound selected from the group consisting of methylenebisacrylamide, glycol diacrylate, glycol dimethacrylate, glyceryl triacrylate, triallylamine, pentaerythritol triallyl ether, polyalkylene glycol at least twice esterified with acrylic acid and/or methacrylic acid, and a polyol, e) a monomer containing vinylamine units, wherein the vinylamine units (e) are obtained by partly or completely eliminating the groups —CO—$R^1$ from the monomer I units copolymerized in the polymer to form amino groups, wherein the fraction of amino groups in the copolymer is greater by at least 10 mol % than the fraction of units of monoethylenically unsaturated acidic monomers (b).

11. The process according to claim 1, wherein said polymer comprising vinylamine units comprises polyvinylamine and/or at least 50 mol % hydrolyzed homopolymers of N-vinylformamide.

12. The process according to claim 1, wherein the polymer comprising vinylamine units and said polymeric anionic compound are each used in an amount of 0.1 to 2.0% by weight, based on dry paper pulp.

13. The process according to claim 1, wherein a ratio of the polymer comprising vinylamine units to the polymeric anionic compound is 5:1 to 1:5.

14. The process according to claim 1, wherein a ratio of the polymer comprising vinylamine units to the polymeric anionic compound is 2:1 to 1:2.

15. The process according to claim 1, wherein the vinyl ester is at least one vinyl acetate and vinyl propionate.

16. The process according to claim 1, wherein said polymeric anionic compound consists of the monomers (a), (b), and (c) which are copolymerized.

17. The process according to claim 1, wherein said polymeric anionic compound consists of the monomers (a) and (b) which are copolymerized.

* * * * *